US005881927A

United States Patent [19]

Inagawa

[11] Patent Number: 5,881,927

[45] Date of Patent: Mar. 16, 1999

[54] PUMP MECHANISM

[75] Inventor: Yoshinori Inagawa, Tokyo, Japan

[73] Assignee: KAO Corporation, Tokyo, Japan

[21] Appl. No.: 696,802

[22] Filed: Aug. 14, 1996

[30] Foreign Application Priority Data

Sep. 7, 1995 [JP] Japan ..... 7-230520
Apr. 16, 1996 [JP] Japan ..... 8-093770

[51] Int. Cl.[6] ..... B67D 5/42

[52] U.S. Cl. ..... 222/321.7; 222/321.9; 222/336

[58] Field of Search ..... 222/321.1, 321.7, 222/321.9, 339, 336, 340

[56] References Cited

U.S. PATENT DOCUMENTS

| | | | |
|---|---|---|---|
| 3,561,644 | 2/1971 | Works et al. . | |
| 4,452,379 | 6/1984 | Bundschuh | 222/321.7 X |
| 5,267,673 | 12/1993 | Crosnier et al. | 222/321.7 |
| 5,316,198 | 5/1994 | Fuchs et al. . | |
| 5,363,993 | 11/1994 | Mascitelli et al. | 222/321.9 |
| 5,518,147 | 5/1996 | Peterson et al. | 222/321.7 X |
| 5,673,824 | 10/1997 | Evans | 222/321.9 |
| 5,704,519 | 1/1998 | Crosnier et al. | 222/321.9 X |

FOREIGN PATENT DOCUMENTS

| | | | |
|---|---|---|---|
| 2 261 202 | 9/1975 | France . | |
| 2 434 943 | 3/1980 | France . | |
| 2643338 | 8/1990 | France | 222/321.7 |
| 2 707 605 | 1/1995 | France . | |

*Primary Examiner*—Kenneth Bomberg
*Attorney, Agent, or Firm*—Oblon, Spivak, McClelland, Maier & Neustadt, P.C.

[57] ABSTRACT

In a pump mechanism attached to a container to fill a liquid and eject the liquid from the container, the pump mechanism includes: a cylinder having a liquid introduction port; a piston which is displaceable in the cylinder; an ejection guide path for the liquid, the path being communicated with the space in the cylinder, the liquid stored in the cylinder being ejected via the ejection guide path by a pushing force which causes the piston to be displaced from the original position to a displaced position; and a recovery device for restoring the piston from the displaced position to the original position by a gas pressure and storing the liquid in the cylinder when the pushing force is released. The pushing force causes the space in the piston to enter a substantially vacuum state, and the gas pressure is generated by a pressure difference between the internal pressure of the space and atmospheric pressure acting via the liquid on the piston. With the pump mechanism, when it is to be subjected to a disposal process or a recycle process, it is not required to conduct selection according to the material and which can be therefore subjected to such a process at a low cost.

2 Claims, 7 Drawing Sheets

PUMP MECHANISM

BACKGROUND OF THE INVENTION

1. Field of the Invention

The invention relates to a pump mechanism which is to be attached to a container filled with a liquid such as hand soap, a shampoo, or a hair rinse and which sucks up the liquid from the container and then ejects the sucked liquid.

2. Description of Related Art

Recently, because of ease of use, a liquid supplying device which is configured so as to supply a suitable amount of a liquid by a one-push operation is widely used. In such a device, particularly high importance is placed on a pump mechanism which sucks up the liquid stored in the container and ejects a constant amount of the liquid.

Referring to FIGS. 9 and 10, the structure of a prior art pump mechanism will be described. FIG. 9 is a half section view of the pump mechanism in a state before the liquid ejection, and FIG. 10 is a half section view of the pump mechanism in a state after the liquid ejection.

In FIGS. 9 and 10, a cap-shaped base portion 31 is screwed to an opening of a container (not shown) which is filled with a liquid. A cylinder 32 is fixed to the base portion 31. A ball valve 33 is disposed at the lower end of the cylinder 32. A tube (not shown) for sucking up the liquid via the ball valve 33 is connected to the cylinder 32. A hollow shaft 34 has a cup-shaped piston 34*a* at its lower end. The outer peripheral face of the piston 34*a* is closely contacted with the inner peripheral face of the cylinder 32.

A head 35 and a nozzle 36 which are integrated with each other are attached to the upper end of the shaft 34. A ball valve 37 is disposed at a position of the shaft 34 in the vicinity of the head 35.

A coil spring 38 which is made of a metal is placed between the cylinder 32 and the shaft 34. A guide member 39 is disposed so that the coil spring 38 does not deflect into an like shape but vertically expands and contracts. The guide member 39 functions also as a stopper which restricts the movable range of the ball constituting the ball valve 33.

In the thus configured pump mechanism, when the head 35 is pushed down under the state where the liquid stays in the cylinder 32 (the state shown in FIG. 9), the liquid pressure is raised and only the ball valve 37 is opened so that the liquid is ejected through the nozzle 36.

When the head 35 is released under the state where the ejection of the liquid is completed (the state shown in FIG. 10), the piston 34*a* is pushed up by the recovery force of the coil spring 38 which has been compressed during the operation of pushing down the head 35. At this time, a negative pressure is generated in the cylinder 32 and only the ball valve 33 is opened so that the liquid is sucked up into the cylinder 32 and the ejection preparatory state is established.

When such a prior art pump mechanism is to be subjected to a disposal process or a recycle process, materials of different kinds, i.e., resins and metals must be separated from each other prior to the execution of such a process. Specifically, a pump mechanism is manually once disassembled, and the coil spring 38 made of a metal is then detached from the body made of a resin. Therefore, the disposal cost is high.

In the pump mechanism, when it is used for a long period, there is the fear of a trouble due to the reduction of the performance of the coil spring 38. Specifically, the coil spring 38 is always immersed in the liquid and hence easily rusts. This may cause the resilient force to be reduced or the spring to be broken. When such a defect occurs, the coil spring 38 cannot exert a required resilient performance and hence the positional recovery of the piston 34*a* is disabled. As a result, the liquid cannot be again ejected.

A prior art pump mechanism has a further problem in addition to the problems discussed above. Namely, in order to reduce the consumption of raw materials in production and efficiently use resources, it is strongly requested to reduce the size of a pump mechanism and simplify the structure of the pump mechanism.

The pump mechanism has a further problem as follows: The degree of the recovery force of the piston 34*a* must be appropriately set in accordance with the kind of the liquid. When a gel liquid having a high viscosity is to be handled, for example, the recovery force must be set to be high. This is because a liquid having a high viscosity is inferior in flowability and the piston 34*a* must be raised at a higher speed so that a negative pressure higher than that in the case of a usual liquid is generated in the cylinder 32. To comply with this, in the prior art, the recovery force is adjusted by replacing the coil spring 38 with one having another resilient force, i.e., another spring constant. Consequently, it is required to prepare various kinds of coil springs having different spring constants so as to increase the production cost.

SUMMARY OF THE INVENTION

The invention has been conducted in order to solve these problems. It is a primary object of the invention to provide a pump mechanism in which, when it is to be subjected to a disposal process or a recycle process, it is not required to conduct selection according to the material and which can be therefore subjected to such a process at a low cost.

It is a secondary object of the invention to provide a pump mechanism which is superior in durability, hardly causes an operation failure even when it is used for a long period, and has a simple structure or a reduced number of parts.

It is a tertiary object of the invention to provide a pump mechanism in which a reaction force or a recovery force generated when a liquid is to be ejected can be easily changed so as to be suitable for the kind of the liquid.

The objects can be attained by a pump mechanism which is to be attached to a container to be filled with a liquid, ejects the liquid from the container, and includes: a cylinder having a liquid introduction port; a piston which is displaceable in the cylinder; an ejection guide path for the liquid, the path being communicated with the space in the cylinder, the liquid stored in the cylinder being ejected via the ejection guide path by a pushing force which causes the piston to be displaced from the original position to a displaced position; and a recovery device for restoring the piston from the displaced position to the original position by a gas pressure, and storing the liquid in the cylinder when the pushing force is released, the gas pressure being generated by the pushing force.

In a first mode of the pump mechanism of the invention, the pump mechanism further includes: a cap-shaped base portion which is engaged with the container in order to attach the cylinder, a through hole being formed at the center of the base portion; a first valve which is disposed in the vicinity of the liquid introduction port and allows the liquid to pass through the first valve only in a direction from the container to the cylinder; a second valve which is disposed in the vicinity of the ejection guide path and allows the liquid to pass through the second valve only in a direction from the cylinder to a liquid ejection port; and a shaft which is guided by the base portion, elongates from the piston, and has the ejection guide path, the piston being displaced through the shaft. The pushing force causes the space in the piston to enter a substantially vacuum state, and the gas pressure is generated by a pressure difference between the internal pressure of the space and atmospheric pressure acting via the liquid on the piston.

In a second mode of the pump mechanism of the invention, the pump mechanism further includes: a cap-shaped base portion which is engaged with the container in order to attach the cylinder, a through hole being formed at the center of the base portion; a first valve which is disposed in the vicinity of the liquid introduction port and allows the liquid to pass through the first valve only in a direction from the container to the cylinder; a second valve which is disposed in the vicinity of the ejection guide path and allows the liquid to pass through the second valve only in a direction from the cylinder to a liquid ejection port; and a shaft which is guided by the base portion, elongates from the piston, and has the ejection guide path, the piston being displaced through the shaft. The pump mechanism includes a gas filled chamber which is disposed in the base portion, and an auxiliary piston which is displaceable in the gas filled chamber with interlocking with the piston, the gas pressure being generated by the pressure of a gas which is compressed in the gas filled chamber by the auxiliary piston.

In the second mode, preferably, the shaft elongating from the piston is cylindrical, a through hole is formed at a position of the piston corresponding to the shaft, and the shaft functions as at least a part of the ejection guide path. When this configuration is employed, the structure of the pump mechanism can be further simplified.

In a third mode of the pump mechanism of the invention, the pump mechanism further includes: a cap-shaped base portion which is engaged with the container in order to attach the cylinder, a through hole being formed at the center of the base portion; a first cylinder which is disposed in the base portion, liquid return holes being formed in the peripheral face of the first cylinder; a second cylinder which is continued from a bottom face side of the first cylinder and has the liquid introduction port; a first valve which is disposed in the vicinity of the liquid introduction port and allows the liquid to pass through the first valve only in a direction from the container to the second cylinder; a first piston which is annular and displaceable in the first cylinder, a first through hole being formed at the center of the first piston; a first shaft which elongates from the first piston, and contains a first ejection guide path corresponding to the first through hole, and a first liquid return path which elongates in substantially parallel with the first ejection guide path; a second piston which is annular and displaceable in the second cylinder, a second through hole being formed at the center of the second piston, a substantially vacuum space being formed between the second piston and the bottom face of the first cylinder by displacement of the second piston caused by the pushing force; a second shaft which elongates from the second piston, and contains a second ejection guide path which corresponds to the second through hole and which is continuous from the first ejection guide path, the second shaft passing through the bottom face of the first cylinder in an airtight state and connecting the first piston with the second piston; an ejection port unit attached to the first shaft, the ejection port unit containing a third ejection guide path which is continuous from the first ejection guide path, and a second ejection guide path which branches off from the third ejection guide path and is continuous to the first liquid return path; and a second valve which is disposed between the first shaft and the ejection port unit and caused by displacement of the first and second pistons due to the pushing force to allow the liquid stored in the second cylinder to pass between the first and third ejection guide paths only in a direction from the second cylinder to an opening of the ejection port unit, and, when the first and second pistons are to be restored to their original positions by the recovery device, allow the liquid remaining in the third ejection guide path to pass between the first and second ejection guide paths only in a direction from the ejection port unit to the first cylinder.

In the pump mechanism of the third mode, preferably, an annular projection through which the second shaft passes is formed in the bottom face of the first cylinder, an annular groove surrounding the second shaft is formed on the inner peripheral face of the projection, and a recess is formed at a position of the outer peripheral face of the second shaft and in the vicinity of the second piston.

This configuration is employed in order that, when air is allowed for some reason to enter the space of the second cylinder between the upper end face of the second piston and the lower end face of the annular projection, the air can be easily discharged to the exterior. Specifically, with a pump mechanism having such a structure, when the second piston is raised to a level higher than the upper limit for a normal use, the recess of the second shaft encounters the annular groove of the annular projection in the course of the raising operation so as to form an air discharge path which elongates from the recess to the first cylinder via the annular groove. Therefore, the air which has entered the second cylinder can be easily discharged toward the first cylinder. When this process is conducted periodically, the interior of the second cylinder can be kept to a required degree of vacuum so that the pump mechanism is prevented from being lowered in ability. A pump mechanism which can employ such a structure is limited in principle to that in which a substantially vacuum space is always formed between the upper face of the second piston and the lower end face of the annular projection. In a pump mechanism having another structure such as that in which the upper face of the second piston and the lower end face of the annular projection are always closely contacted with each other, it is not required to conduct the air vent operation and hence the above-mentioned configuration is not necessary.

As described above, in the pump mechanism of the invention, the piston is restored by the pressure difference between atmospheric pressure and the pressure of the compressed gas or the internal pressure of the substantially vacuum space in which a substantially vacuum state is attained, and hence a coil spring is not necessary. The recovery device which is used in place of a coil spring can be made a resin material in the same manner as the body of the pump mechanism. Unlike a pump mechanism which uses a coil spring made of a metal, therefore, the pump mechanism of the invention is not required to be disassembled and separated when it is to be subjected to a disposal process or a recycle process, and the disposal cost can be suppressed to a low level.

Since a coil spring made of a metal which is easily caused to rust by a liquid is not used, there occurs no failure even when the pump mechanism is used for a long period, and the pump mechanism is superior in durability.

Furthermore, in addition to a coil spring, also a guide member can be eliminated. This allows the space in the cylinder to be efficiently used, so that the height (the dimension in the direction along which the piston is displaced) is reduced. Consequently, the pump mechanism can be reduced in size. Furthermore, the number of parts can be reduced in accordance with the elimination of a coil spring and a guide member, and hence the structure can be simplified.

In the pump mechanism of the invention, the reaction force (recovery force) generated when the piston is pushed down can be arbitrarily adjusted by changing the initial set position of the piston with respect to the cylinder, i.e., the amount of air existing in the cylinder in the initial state. For example, the piston is set to be in close proximity to a lid which is to be mounted on the cylinder (in the case where the pump mechanism has two cylinders, the bottom face of the other one of the cylinders) so that little air remains. In this configuration, immediately after the piston is displaced by the pushing operation, a substantially vacuum space is formed in the cylinder. Under this circumstance, the largest pressure difference between the internal pressure of the cylinder and atmospheric pressure is produced so that the maximum recovery force is obtained. In contrast, when some amount of air is left in the cylinder, the internal pressure is not abruptly lowered even when the piston is pushed down, and hence the recovery force is small. As seen from the above description, in the pump mechanism of the invention, the degree of the recovery force of the piston can be appropriately set in accordance with the kind of the liquid, by a simple operation in which the set position of the piston is changed. Unlike a pump mechanism using a coil spring, therefore, the present pump mechanism does not have a disadvantage that the production cost is increased.

The pump mechanism of the invention can be applied not only to a pump mechanism of the manually pushing type but also to that of the so-called trigger dispenser type. Specifically, the pump mechanism may be configured so that a force is directly or indirectly applied from a trigger which is operated by the index finger or the like, to a shaft elongated from the piston (or the piston itself), so that a liquid from a nozzle is ejected.

DETAILED DESCRIPTION OF THE PREFERRED EMBODIMENTS

Figure 1:
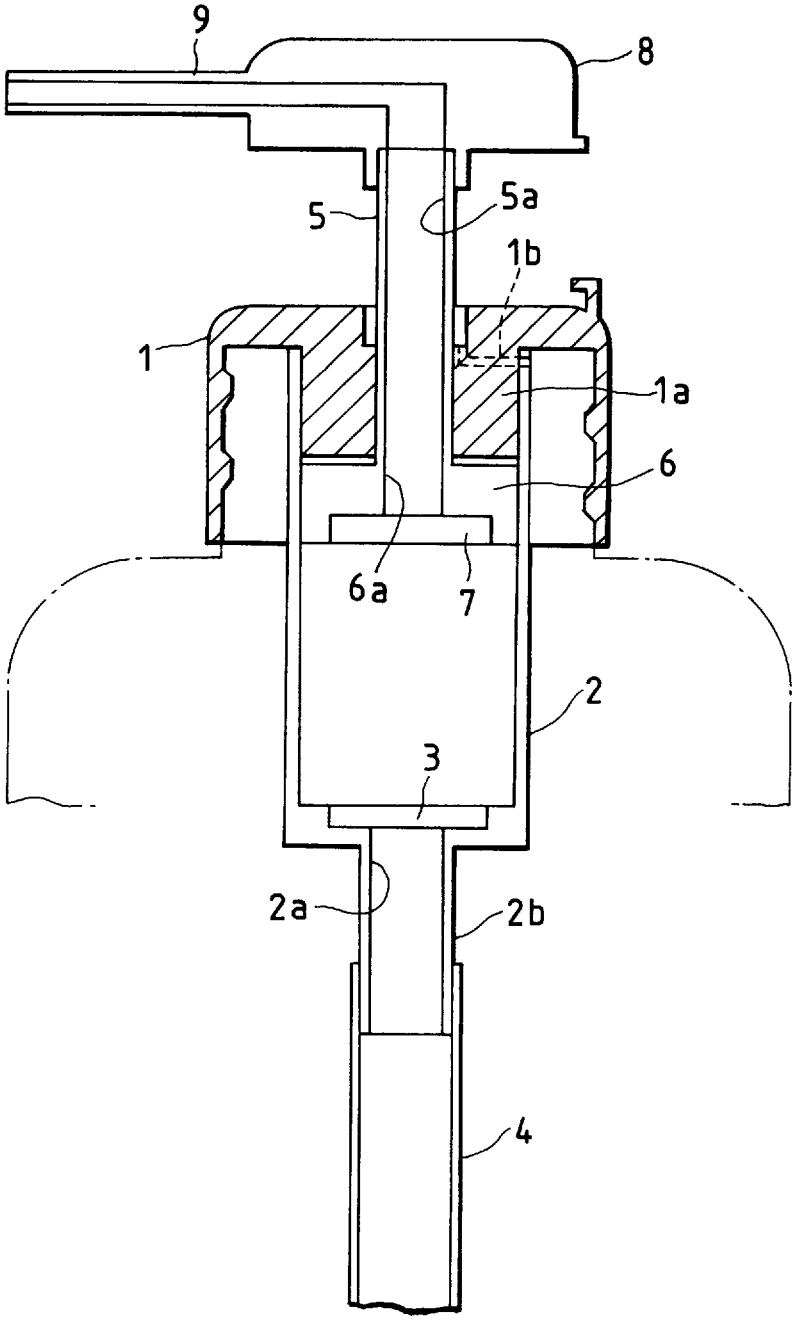
FIG. 1 is a section view of a pump mechanism (first embodiment) in a state before the liquid ejection.
Figure 2:
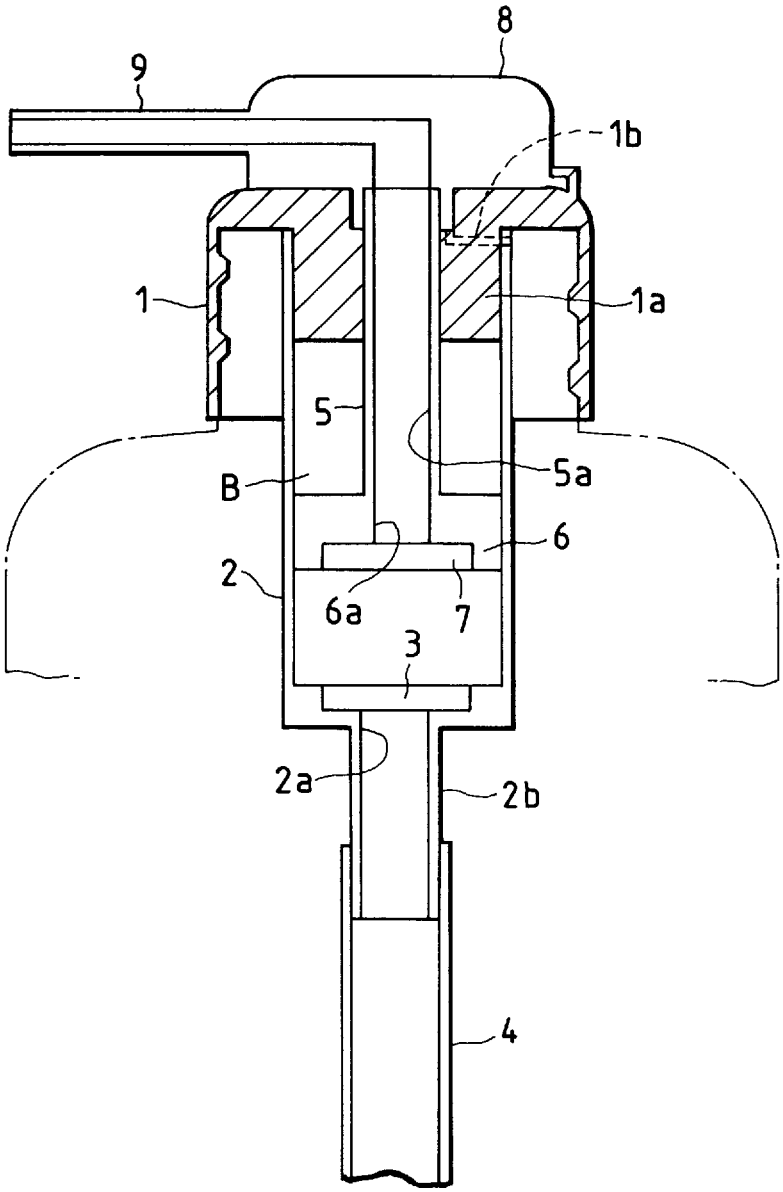
FIG. 2 is a section view of the pump mechanism (first embodiment) in a state after the liquid ejection.

Embodiments of the invention will be described in detail with reference to the accompanying drawings. FIGS. 1 and 2 show a first embodiment of the invention. A cap-shaped base portion 1 is disposed so as to be screwed to an opening of a container (indicated by a one-dot chain line) which is filled with a liquid. A thread groove is formed in the inner peripheral face of the base portion. A cylindrical projection (lid) 1*a* is integrally formed at the center of the back face of the base portion 1. A small hole 1*b* for introducing atmospheric pressure into the container is formed in the projection 1*a*. A cylinder 2 is fitted and fixed onto the projection 1*a*. In order to prevent air form entering the interior of the cylinder 2, the junction between the cylinder and the projection is provided with excellent airtightness.

A liquid introduction port 2*a* is formed in the bottom face of the cylinder 2, and a three-point suspension valve (first valve) 3 is attached to the port. A tube 4 for sucking up the liquid in the container is connected to a conduit tube 2*b* continuous from the liquid introduction port 2*a*.

A cylindrical shaft 5 has an ejection guide path 5*a* which is formed in the shaft. The shaft passes through the projection 1*a* of the base portion 1 in an airtight state to be guided.

A piston 6 is disposed at the lower end of the shaft 5, and the outer peripheral face of the piston 6 is closely contacted with the inner peripheral face of the cylinder 2. In other words, the piston 6 is displaceable while the airtightness of the interior of the cylinder 2 is maintained.

A three-point suspension valve (second valve) 7 is attached to the bottom face of the piston 6 so as to correspond to a through hole 6*a*.

A nozzle 9 is integrated with a head 8.

In the thus configured pump mechanism, when the head 8 is pushed down under the state where the liquid stays in the cylinder 2 (the state shown in FIG. 1), the pressure of the liquid is increased so that the three-point suspension valve 7 is opened (while the three-point suspension valve 3 remains to be closed). The liquid passes through the opened three-point suspension valve 7, and then through the ejection guide path 5*a*, to be finally ejected from the nozzle 9.

At the same time, a space B which is in substantially vacuum is formed between the upper end face of the piston 6 and the lower end face of the projection 1*a*. Consequently, the piston 6 is acted upon by an upward force due to the pressure difference between atmospheric pressure acting through the liquid and the internal pressure of the space B. Namely, a reaction force acting against the force for pushing down the head 8 is generated. The more the piston 6 is pushed down, the more the reaction force is increased in magnitude.

When the head 8 is pushed down to the final position with opposing the reaction force and the amount of the liquid corresponding to the one operation is completely ejected from the cylinder 2, the state shown in FIG. 2 is attained.

When the force applied to the head 8 is released under this state, the piston 6 is pushed up by the recovery force due to the pressure difference between atmospheric pressure and the internal pressure of the space B which is in substantially vacuum. This causes the three-point suspension valve 3 to be opened (while the three-point suspension valve 7 remains to be closed) so that the liquid is sucked up into the cylinder 2. When the piston 6 is returned to the position where the piston was situated before the ejection of the liquid and the cylinder 2 is entirely filled with the liquid, the preparatory state in which the ejection is enabled is again established.

As described above, in the first embodiment of the invention, the force due to the pressure difference between atmospheric pressure and the internal pressure of the space B which is in substantially vacuum is used as the recovery means for the piston 6. Therefore, a coil spring made of a metal is not necessary. When the pump mechanism is to be subjected to a disposal process or a recycle process, therefore, it is not required to conduct selection according to the material and the pump mechanism can be therefore subjected to such a process at a low cost.

Unlike a pump mechanism which uses a coil spring made of a metal, for example, the present pump mechanism is free from an operation failure due to rust and stably exhibits the ejection ability for a long period.

Furthermore, the space in the cylinder can be efficiently used in accordance with the elimination of a metal coil spring and a guide member, and the height can be reduced. In addition, the number of parts can be reduced as compared with a prior art pump mechanism, and hence the structure can be simplified in accordance with the reduction of the number of parts.

Figure 3:
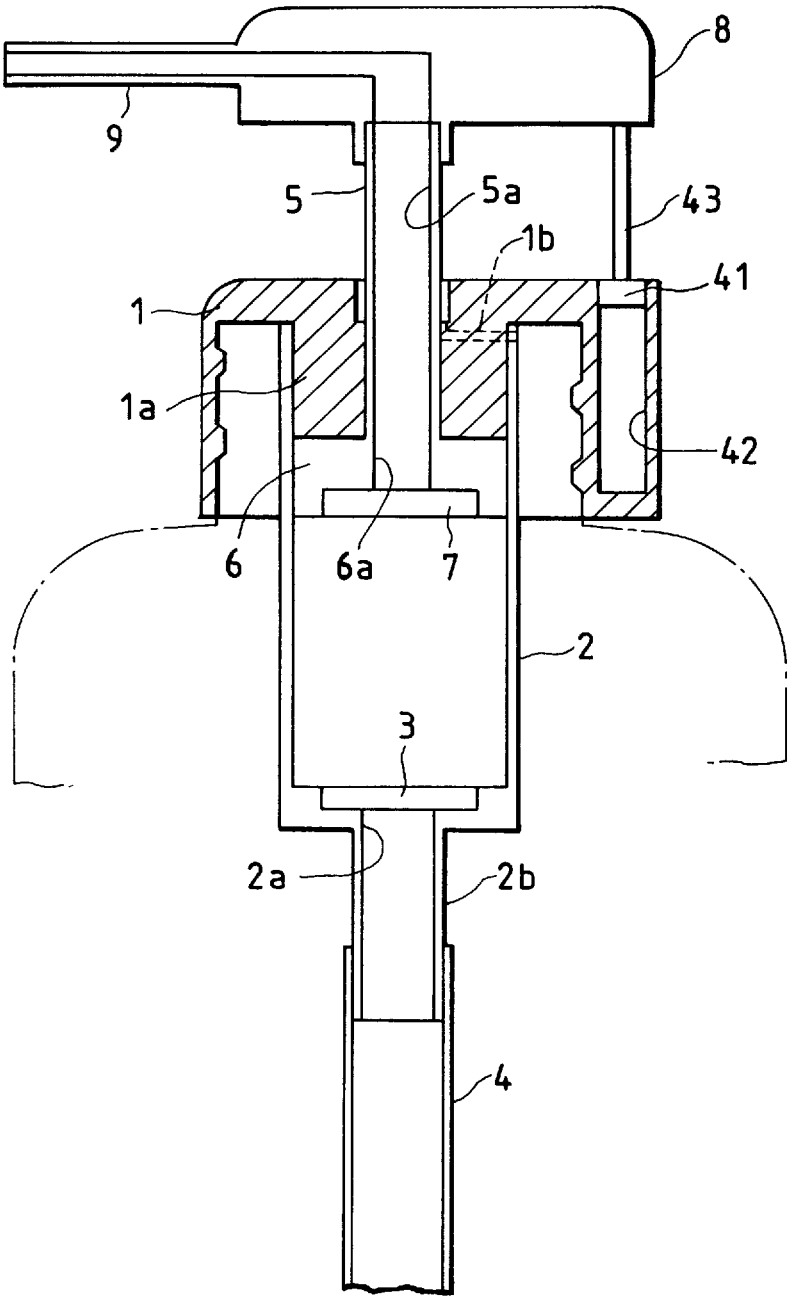
FIG. 3 is a section view of a pump mechanism (second embodiment) in a state before the liquid ejection.
Figure 4:
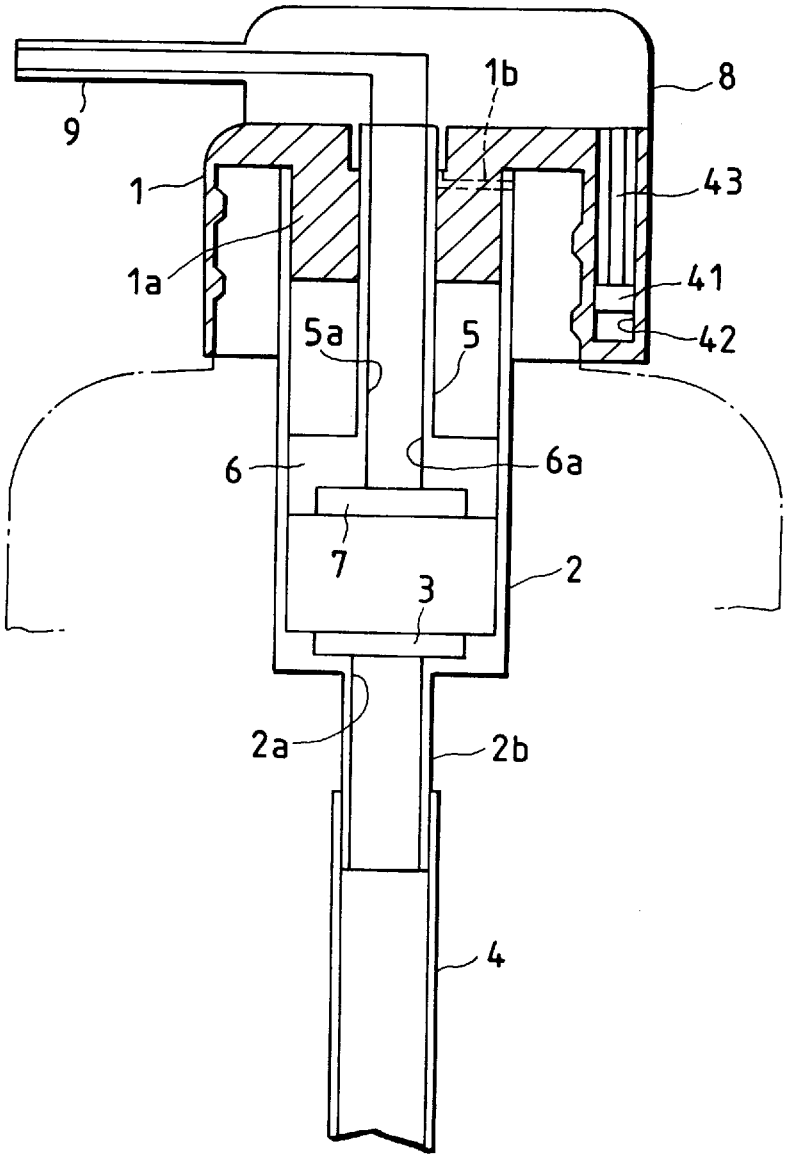
FIG. 4 is a section view of the pump mechanism (second embodiment) in a state after the liquid ejection.

FIGS. 3 and 4 show a second embodiment of the invention.

The embodiment is different from the first embodiment in that an auxiliary piston 41 is disposed so as to be displaceable in an air filled chamber (gas filled chamber) 42 which is integrated with the base portion 1, while maintaining the airtightness. The air filled chamber 42 takes the place of the space B in the first embodiment. The other configuration of the second embodiment is the same as that of the first embodiment. Therefore, the corresponding components are designated by the same reference numerals and their description is omitted.

The auxiliary piston 41 is coupled to the head 8 by a rod 43 so as to interlock with the piston 6 for discharging the liquid. The recovery means configured by the air filled chamber 42 and the auxiliary piston 41 restores the piston 6 to the original position, by using the pressure of air which, when the head 8 is pushed down, is compressed in the air filled chamber 42 by the auxiliary piston 41.

The thus configured pump mechanism operates in the following manner. When the head 8 is pushed down by a hand under the state where the liquid stays in the cylinder 2 (the state shown in FIG. 3), the pressure of the liquid in the cylinder 2 is increased so that only the three-point suspension valve 7 is opened so that the liquid passes through the ejection guide path 5*a* and then ejected from the nozzle 9. When the head 8 is pushed down to the final position with opposing the reaction force acting on the auxiliary piston 41 and the liquid is completely ejected, the state shown in FIG. 4 is attained. When the head 8 is released under this state, the auxiliary piston 41 is pushed up by the pressure of the air compressed in the air filled chamber 42 and also the piston 6 is raised together with the movement of the auxiliary piston. At the same time, only the three-point suspension valve 3 is opened so that the liquid is sucked up into the cylinder 2. Finally, the piston 6 is returned to the original position and the cylinder 2 is filled with the liquid so that the preparatory state in which the ejection is enabled is again established.

As described above, also in the pump mechanism of the second embodiment, the air pressure is used as the recovery means. Therefore, a coil spring made of a metal is not necessary, and the pump mechanism can attain the same effects as the first embodiment.

FIGS. 5 to 8 show a third embodiment of the invention.

A base portion 10 is screwed to an opening of a container (not shown). A fist cylinder 11 is integrated with the base portion 10. Through holes (liquid return holes) 11a are opened at predetermined intervals, for example, intervals of 180° in the peripheral face of the first cylinder 11. The through holes 11a are used for returning the returning amount of the liquid into the container as described later in detail.

A second cylinder 12 is fitted onto an annular projection 13 which is integrated with the bottom face of the first cylinder 11. The junction portion is provided with excellent airtightness by closely contacting the whole peripheral area of the second cylinder with the annular projection.

A liquid introduction port 12*a* is formed in the bottom face of the second cylinder 12. A three-point suspension valve (first valve) 14 is attached at that position. A tube (not shown) for sucking up the liquid from the container is connected to a conduit tube 12*b* continuous from the liquid introduction port 12*a* .

A first shaft 15 has a first ejection guide path 15*a* which is formed in the shaft, and is guided by the base portion 10 so as to be vertically displaceable.

A first piston 16 having a through hole continuous from the first ejection guide path 15*a* is integrated with the lower end portion of the first shaft 15. The outer peripheral face of the first piston 16 is closely contacted with the inner peripheral face of the first cylinder 11, so that the first piston is displaceable while the airtightness of the interior of the first cylinder 11 is maintained.

In the first shaft 15, a first liquid return path 15*b* is formed in addition to the first ejection guide path 15*a*. The first liquid return path 15*b* passes through the first piston 16.

A second shaft 17 has a second ejection guide path 17*a* which is formed in the shaft, and passes through the bottom face of the first cylinder 11, i.e., the annular projection 13 while maintaining the airtightness. The second shaft 17 is fitted into the first shaft 15 so that the first and second ejection guide paths 15*a* and 17*a* constitute one continuous ejection guide path.

A second piston 18 having a through hole continuous from the second ejection guide path 17*a* is integrated with a lower end portion of the second shaft 17. The first and second pistons 16 and 18 are connected to each other by the second shaft 17 so as to interlock with each other.

A head (ejection port unit) 20 is integrated with a nozzle 19. The head 20 is attached to the first shaft 15 with disposing therebetween a valve (second valve) 21 which has a dish-like section shape and the same directionality as the three-point suspension valve 14. Although not particularly illustrated, a slit having, for example, a straight-line shape is formed in the center portion of the valve 21, i.e., in an area opposing the opening of the first ejection guide path 15*a*. The edge portion surrounding the slit excepting a part of the unit adheres to the head 20.

A second liquid return path 22 branches off from the flow path (third ejection guide path) of the head 20. In the valve 21, the part which does not adhere to the head 20 is a portion corresponding to the second liquid return path 22 and the vicinity of the portion. When the head 20 returns to the original position after the liquid ejection, the nonadhesion portion of the valve 21 is sucked and deformed by a negative pressure which is generated in the first cylinder 11. This causes the opening of the second liquid return path 22 which has been closed by the valve 21, to be opened. Consequently, the liquid remaining in the nozzle 19 flows down through a gap which is formed as a result of the deformation of the valve 21, and is then sucked into the first cylinder 11 via the first liquid return path 15*b*.

An annular groove 23 surrounding the second shaft 17 is formed on the inner peripheral face of the projection 13 disposed on the bottom face of the first cylinder 11. A recess 24 is formed at a position of the outer peripheral face of the second shaft 17 and in the vicinity of the second piston 18. The annular groove 23 and the recess 24 are used in the air vent operation for maintaining a required degree of vacuum as described later.

Spline grooves 25 are formed at predetermined intervals in the inner peripheral face of the center through hole of the base portion 10. Projection pieces 26 are formed on the outer peripheral face of the first shaft 15 at intervals corresponding to the spline grooves 25. When the first shaft 15 is pushed down after aligning the projection pieces with the grooves, therefore, the projection pieces 26 can pass over the portion where the spline grooves 25 are formed. Thereafter, the first shaft 15 is slightly rotated so that the projection pieces 26 block the spline grooves 25. Even when the pushing force is then released, therefore, the first shaft 15 cannot be again projected to the original level. In this way, the first shaft 15 is normally restricted so as to be projected to the level shown in FIG. 5.

Also with the pump mechanism configured as described above, when the head 20 is pushed down under the state where the liquid stays in the lower space of the second cylinder 12 (the state shown in FIG. 5), the pressure of the liquid is raised and the valve 21 is opened (while the three-point suspension valve 14 remains to be closed). The liquid passes through the opened valve 21 and is then ejected from the nozzle 19.

At the same time, the lowering operation of the first piston 16 causes the liquid in the first cylinder 11 (the returning amount of the liquid) to be discharged from the through holes 11*a* so that the liquid is returned into the container.

Figure 6:
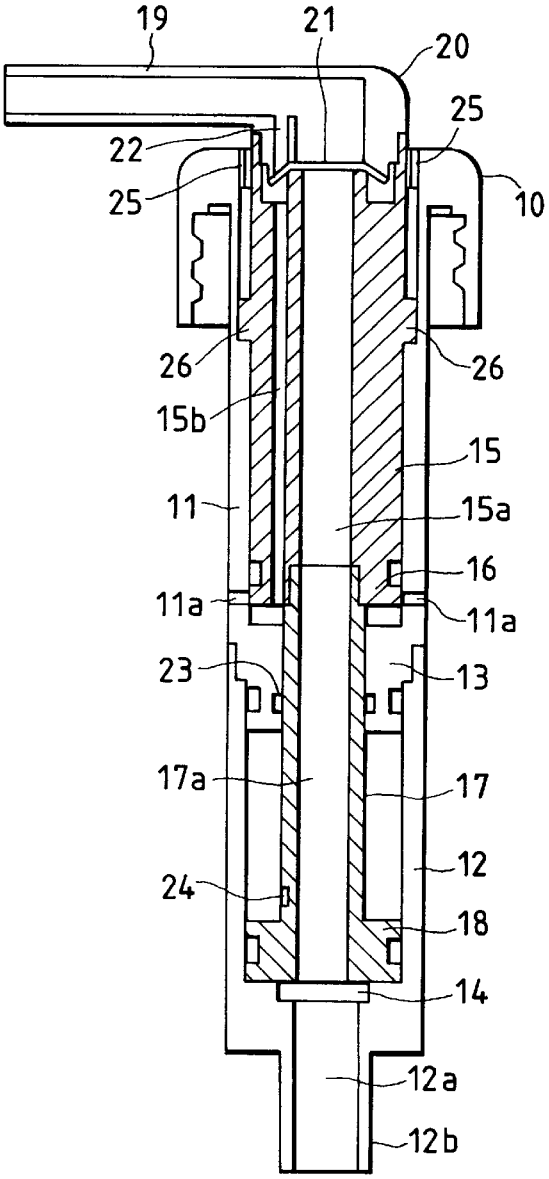
FIG. 6 is a section view of the pump mechanism (third embodiment) in a state after the liquid ejection.

When the second piston 18 is lowered in the operation of ejecting the liquid, the gap between the upper end face of the piston and the lower end face of the annular projection 13 becomes larger. Consequently, the second piston 18 is acted upon by an upward force due to the pressure difference between atmospheric pressure and the internal pressure of the upper space (vacuum chamber) of the second cylinder 12. This appears as a reaction force (recovery force) acting against the force for pushing down the head 20. When the head 20 is pushed down to the final position with opposing the reaction force and the amount of the liquid corresponding to the one operation is ejected, the state shown in FIG. 6 is attained.

After the ejection of the liquid, the force applied to the head 20 is released. Then the second piston 18 is pushed up to the original position by the recovery force. This causes the three-point suspension valve 14 to be opened (while the valve 21 remains to be closed) so that the liquid is sucked up into the lower space of the second cylinder 12.

As the second piston 18 is raised, also the first piston 16 is raised, and hence a negative pressure is generated in the first cylinder 11. Then the nonadhesion portion of the valve 21 is sucked and deformed so that the liquid which has not been ejected and remains in the nozzle 19 passes through the valve. The liquid which has passed through the valve 21 is then sucked into the first cylinder 11 via the first liquid return path 15*b*. Consequently, the liquid is prevented from dropping from the tip end of the nozzle 19.

Figure 5:
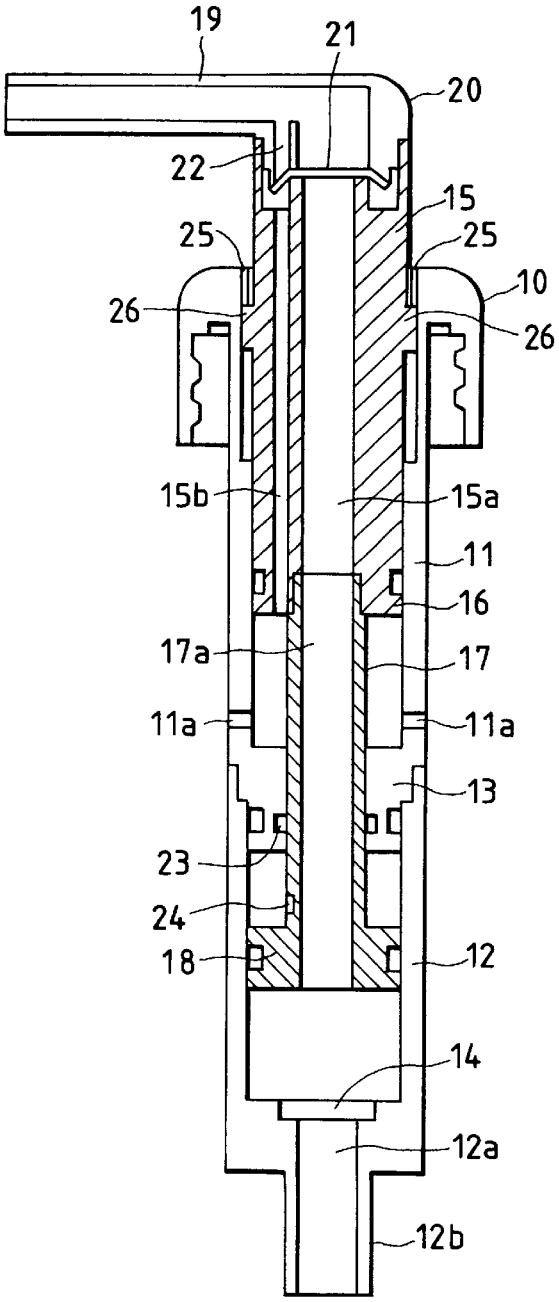
FIG. 5 is a section view of a pump mechanism (third embodiment) in a state before the liquid ejection.

At the timing when the second piston 18 is returned to the position where the piston was situated before the ejection of the liquid, or to the state of FIG. 5, the lower space of the second cylinder 12 is filled with the liquid, and the preparatory state in which the ejection is enabled is again established.

In the pump mechanism having the above-described structure, it is possible that air is allowed for some reason to enter the upper space of the second cylinder 12 (the space between the upper end face of the second piston 18 and the lower end face of the annular projection 13). To comply with this, the embodiment is configured so that the air vent operation is enabled.

The air vent operation is performed in the following manner. First, the first shaft 15 is adequately rotated so as to cancel the positional restriction due to the combination of the spline grooves 25 and the projection pieces 26. This enables the head 20 to be raised to a level higher than the upper limit for a normal use.

Figure 7:
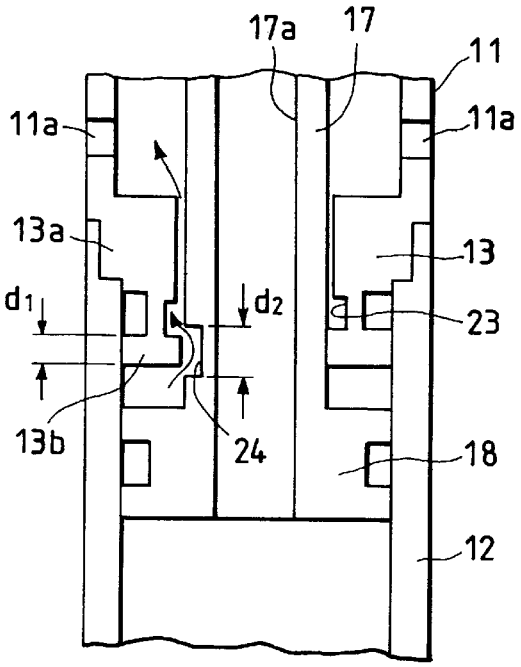
FIG. 7 is a section view showing a state where an air discharge path is formed.
Figure 8:
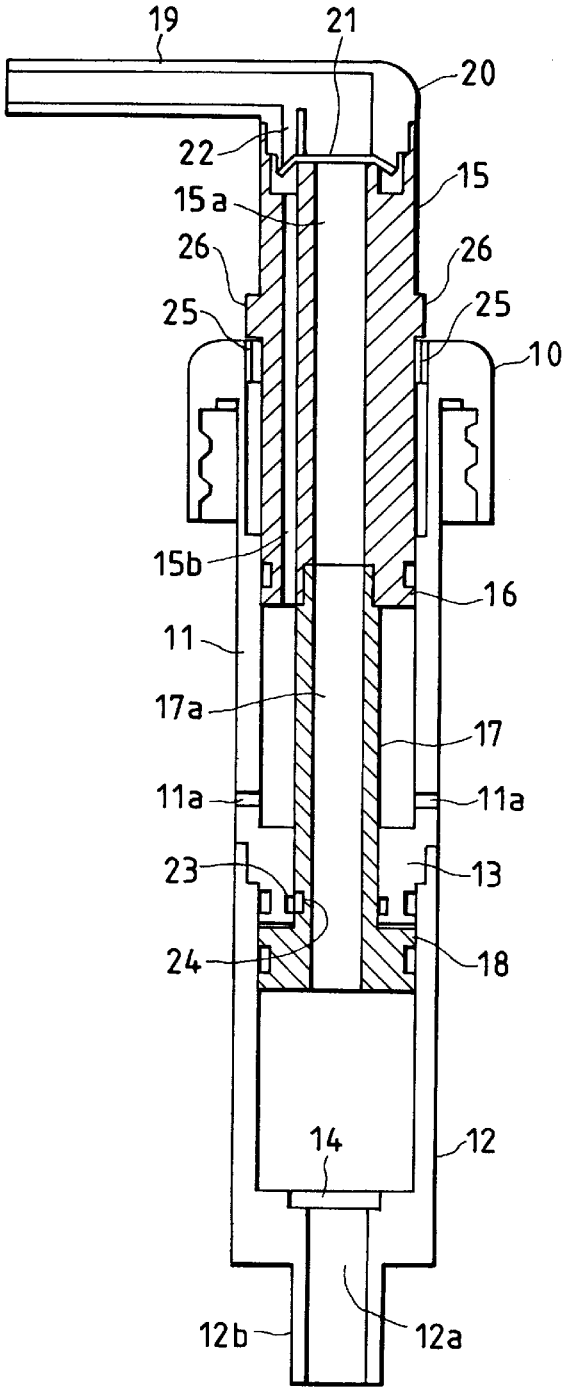
FIG. 8 is a section view showing a state where air in a vacuum chamber is temporarily discharged in order to restore the recovery force.
Figure 9:
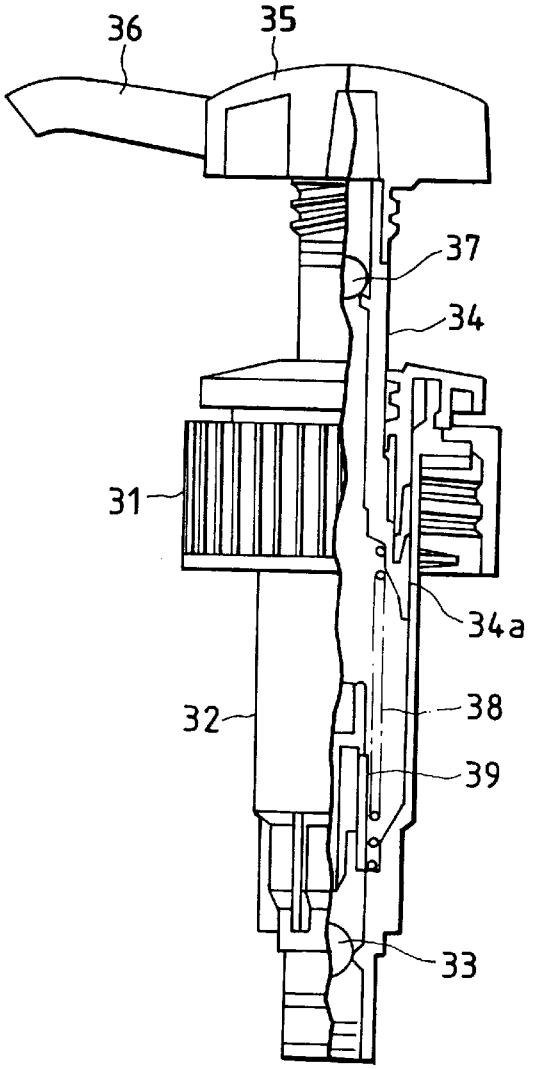
FIG. 9 PRIOR ART
FIG. 9 is a half section view of a prior art pump mechanism in a state before the liquid ejection.
Figure 10:
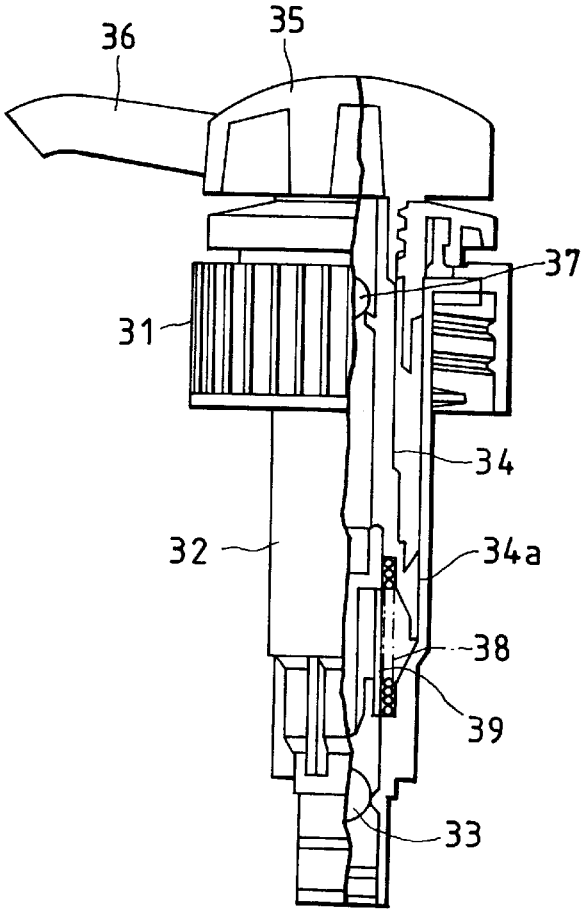
FIG. 10 PRIOR ART
FIG. 10 is a half section view of the prior art pump mechanism in a state after the liquid ejection.

When the head 20 is raised, the recess 24 of the second shaft 17 encounters the annular groove 23 of the annular projection 13 in the course of the raising operation, so that a discharge path for the air which has entered the upper space of the second cylinder 12 is formed as indicated by arrows in FIG. 7. When the head 20 is further raised and the state shown in FIG. 8 is attained, the air which has entered the second cylinder 12 is entirely discharged from the cylinder and the air vent operation is completed.

In order to provide the pump mechanism with such a function, the airtightness between the second shaft 17 and the annular projection 13 is stepwise varied. Specifically, the annular projection 13 is divided into upper and lower halves 13*a*and 13*b* by the annular groove 23. The airtightness between the upper half 13*a* and the second shaft 17 is set to a level which is not so high. In contrast, the airtightness between the lower half 13*b* and the second shaft 17 is set to a level which is very high. As seen from FIG. 7, the width $d_1$ of the lower half 13*b* of the annular projection 13 is smaller than the width $d_2$ of the recess 24.

Consequently, the air which has been allowed by the existence of the recess 24 to pass over the lower half 13*b* and enter the annular groove 23 passes through the space between the upper half 13*a* and the second shaft 17 and is then discharged into the first cylinder 11. When the air vent operation is conducted periodically, the required degree of vacuum can be maintained so that the pump mechanism is prevented from being lowered in ability.

As described above, also in the third embodiment of the invention, the force due to the pressure difference between atmospheric pressure and the internal pressure of the space which is in substantially vacuum is used as the recovery means for the first and second pistons 16 and 18. Therefore, a coil spring made of a metal is not necessary. When the pump mechanism is to be subjected to a disposal process or a recycle process, therefore, it is not required to conduct selection according to the material and the pump mechanism can be therefore subjected to such a process at a low cost.

Unlike a pump mechanism which uses a coil spring made of a metal, the present pump mechanism is free from an operation failure due to rust and stably exhibits the ejection ability for a long period.

In the pump mechanism of the third embodiment and also the pump mechanisms of the first and second embodiments, the head reaction force or the recovery force can be easily adjusted. Conventionally, the recovery force is adjusted by selectively using coil springs which are different in wire diameter or number of turns per unit length. In the pump mechanism of the embodiment, the recovery force can be freely adjusted without using such a cost-consuming method.

When the second piston 18 is set so that little air remains in the upper space of the second cylinder 12, for example, the largest pressure difference between the internal pressure of the second cylinder 12 in the case of pushing down the second piston 18 and atmospheric pressure is produced so that the maximum recovery force is obtained. In contrast, when the second piston 18 is set so that some amount of air is left in the upper space of the second cylinder 12, the internal pressure is not largely lowered even when the piston is pushed down, and hence the recovery force is small.

In the pump mechanism of the embodiment, the recovery force can be adjusted by such a method. Consequently, the pump mechanism can easily cope with various kinds of liquids having different viscosities.

According to the pump mechanism of the invention, when it is to be subjected to a disposal process or a recycle process, it is not required to conduct selection according to the material and hence the pump mechanism can be subjected to such a process at a low cost. The pump mechanism hardly causes an operation failure even when it is used for a long period, and is superior in durability. Furthermore, the pump mechanism can be produced in a smaller size than a prior art one, and has a reduced number of parts and a simple structure. In the pump mechanism, a reaction force or a recovery force generated when a liquid is to be ejected can be easily adjusted so as to be suitable for the kind of the liquid.

What is claimed is:

1. A pump mechanism which is to be attached to a container to be filled with a liquid and ejects the liquid from the container, said pump mechanism comprising:

a cylinder having a liquid introduction port;

a piston which is displaceable in said cylinder;

an ejection guide path for the liquid, said path being communicated with a space in said cylinder, the liquid stored in said cylinder being ejected via said ejection guide path by a pushing force which causes said piston to be displaced from an original position to a displaced position; and recovery means for restoring said piston from the displaced position to the original position by a gas pressure and storing the liquid in said cylinder when the pushing force is released, the gas pressure being generated by the pushing force;

a cap-shaped base portion engaged with said container in order to attach said cylinder, and including a through hole formed at a center of said base portion;

a first valve disposed in the vicinity of said liquid introduction port and passing the liquid through said first valve only in a direction from said container to said cylinder;

a second valve disposed in the vicinity of said ejection guide path and passing the liquid through said second valve only in a direction from said cylinder to a liquid ejection port;

a shaft guided by said base portion, elongating from said piston, and having said ejection guide path, said piston being displaced by said shaft;

a gas filled chamber which is disposed in said base portion; and an auxiliary piston which is displaceable in said gas filled chamber and interlocking with said piston, the gas pressure being generated by the pressure of a gas which is compressed in said gas filled chamber by said auxiliary piston.

2. A pump mechanism according to claim 1, wherein said ejection guide path is configured by a hole formed in said shaft, and said piston has a through hole which is formed so as to be connected to said ejection guide path.

* * * * *